US008049142B2

(12) United States Patent
Blackson et al.

(10) Patent No.: US 8,049,142 B2
(45) Date of Patent: Nov. 1, 2011

(54) CONVECTION PREHEAT SYSTEM AND METHOD FOR RADIANT BAKING

(75) Inventors: Christopher R. Blackson, Uniontown, OH (US); Michel Perreault, Notre-Dame Lourdes (CA); Pierre Marcoux, Laval (CA)

(73) Assignee: Electrolux Home Products, Inc., Charlotte, NC (US)

( * ) Notice: Subject to any disclaimer, the term of this patent is extended or adjusted under 35 U.S.C. 154(b) by 512 days.

(21) Appl. No.: 11/691,851

(22) Filed: Mar. 27, 2007

(65) Prior Publication Data

US 2008/0237212 A1 Oct. 2, 2008

(51) Int. Cl.
*A21B 1/22* (2006.01)
*A21B 1/26* (2006.01)
*A21B 1/40* (2006.01)

(52) U.S. Cl. ..... 219/398; 219/400; 219/411; 219/486; 99/332

(58) Field of Classification Search ..... None
See application file for complete search history.

(56) References Cited

U.S. PATENT DOCUMENTS

| | | | | |
|---|---|---|---|---|
| 3,333,085 | A * | 7/1967 | Colalillo | 219/398 |
| 3,358,122 | A | 12/1967 | Torrey | |
| 5,534,678 | A * | 7/1996 | Bowles et al. | 219/396 |
| 5,688,422 | A | 11/1997 | Landwehr et al. | |
| 5,767,488 | A | 6/1998 | Barger et al. | |
| 6,388,235 | B1 * | 5/2002 | Sauter et al. | 219/400 |
| 6,472,640 | B2 | 10/2002 | Brown et al. | |
| 6,570,136 | B1 * | 5/2003 | Lockwood et al. | 219/398 |
| 6,734,403 | B2 * | 5/2004 | Baker et al. | 219/486 |
| 6,737,614 | B2 | 5/2004 | Keller et al. | |
| 6,943,324 | B2 | 9/2005 | Ahuja | |
| 2002/0066724 | A1 | 6/2002 | Brown et al. | |
| 2002/0092842 | A1 * | 7/2002 | Loveless | 219/400 |
| 2003/0015518 | A1 * | 1/2003 | Baker et al. | 219/486 |
| 2004/0200825 | A1 | 10/2004 | Ahuja | |
| 2005/0173401 | A1 | 8/2005 | Bakanowski | |
| 2006/0289436 | A1 * | 12/2006 | Carbone et al. | 219/400 |

FOREIGN PATENT DOCUMENTS

| | | | |
|---|---|---|---|
| EP | 0950861 | | 10/1999 |
| EP | 1251317 | | 10/2002 |
| JP | 2000296064 | A * | 10/2000 |
| KR | 20050081371 | A * | 8/2005 |
| WO | 2008066267 | | 6/2008 |

OTHER PUBLICATIONS

KR 2005081371 A, Aug. 2005, Lee, partial translation with Figures.*
International Search Report for PCT/EP2008/056618, dated Sep. 17, 2008, 3 pages.

* cited by examiner

*Primary Examiner* — Joseph M Pelham
(74) *Attorney, Agent, or Firm* — Pearne & Gordon LLP

(57) ABSTRACT

A cooking appliance includes a cabinet forming an oven cavity, a broil heating element, a bake heating element, a convection heating system and a controller. The convection heating system develops a flow of heated air into the oven cavity, and includes a fan and a convection heating element. The controller controls activations of the broil, bake and convection heating elements during an oven cavity preheating operation in which the broil heating element and the bake heating element are alternately activated while the convection heating element is activated.

17 Claims, 2 Drawing Sheets

CONVECTION PREHEAT SYSTEM AND METHOD FOR RADIANT BAKING

BACKGROUND OF THE INVENTION

1. Field of the Invention

The present invention relates to convection heating systems for a cooking appliance and, more particularly, to the use of a convection heating system during an oven preheating operation.

2. Description of Related Art

A conventional oven uses radiant heating provided by bake and/or broil heating elements to cook food placed within the oven. A convection oven has a fan for developing convective air flows within the oven, and can cook food more quickly than a comparable conventional oven.

Ovens are typically preheated to a desired cooking temperature prior to the placement of food within the oven. It would be useful to reduce the time required to preheat an oven.

BRIEF SUMMARY OF THE INVENTION

In accordance with one aspect, provided is a cooking appliance including a cabinet forming an oven cavity, a broil heating element, a bake heating element, a convection heating system and a controller. The convection heating system develops a flow of heated air into the oven cavity, and includes a fan and a convection heating element. The controller controls activations of the broil, bake and convection heating elements during an oven cavity preheating operation in which the broil heating element and the bake heating element are alternately activated while the convection heating element is activated.

Further provided is a cooking appliance including a cabinet forming an oven cavity, a broil heating element, a bake heating element, a convection heating system and a controller. The convection heating system includes a fan and a convection heating element. The convection heating element has a power rating that is less than a power rating of the broil heating element and a power rating of the bake heating element. The convection heating system develops a flow of heated air within the oven cavity. The controller controls activations of the broil, bake and convection heating elements during an oven cavity preheating operation in which the broil heating element and the bake heating element are alternately activated while the convection heating element is activated.

DETAILED DESCRIPTION OF EXAMPLE EMBODIMENTS

Figure 1:
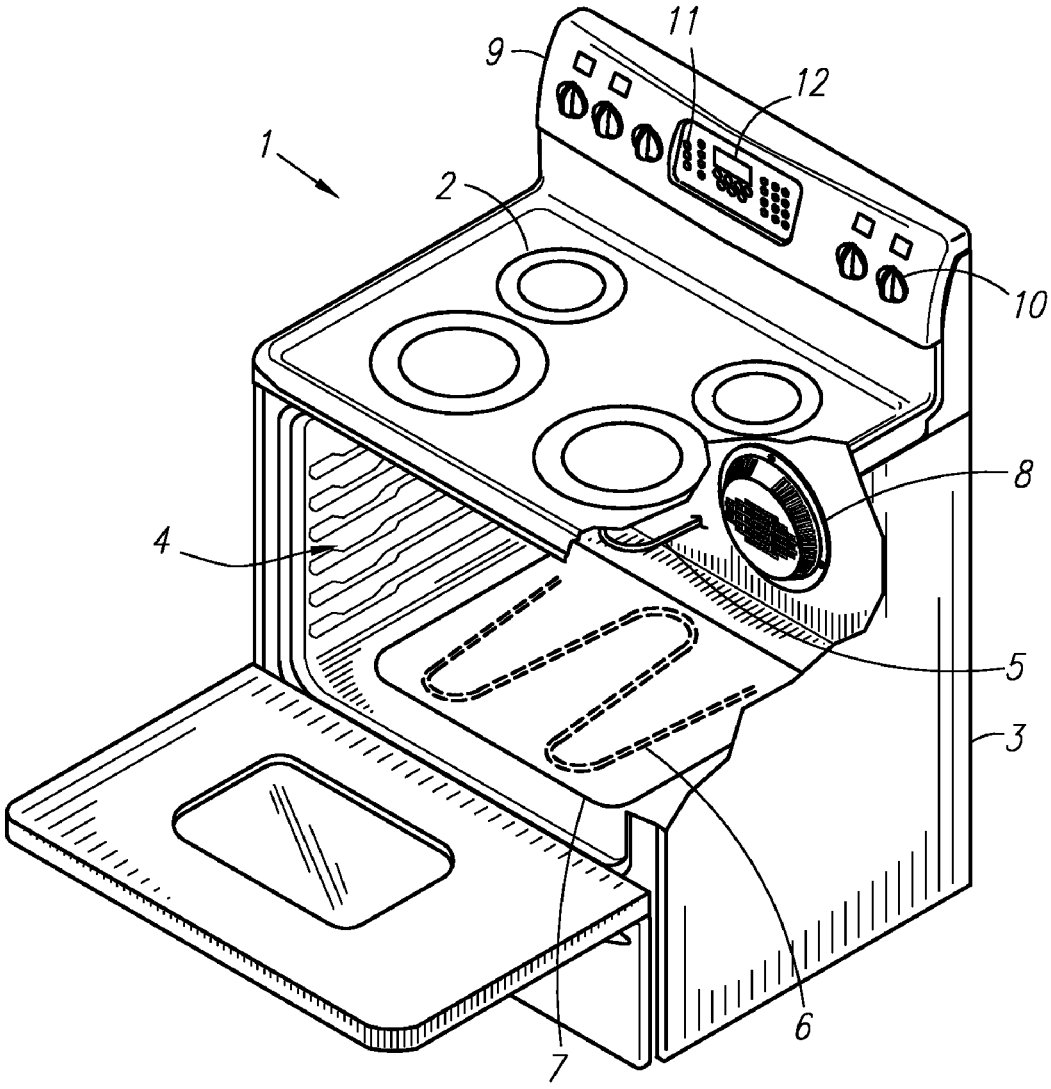
FIG. 1 is a perspective view of a cooking appliance.

FIG. 1 shows an example cooking appliance 1. The cooking appliance 1 is a free standing range having cooktop heating elements 2. A cabinet 3 forms an oven cavity 4. In an embodiment, the cooking appliance 1 is a so-called built-in oven for installation in a wall or cabinetry and having no cooktop surface and associated heating elements 2.

The cooking appliance 1 includes a broil element 5, which is partially shown in FIG. 1. The broil element 5 is mounted at an upper portion of the oven cavity 4. The appliance further includes a bake element 6 mounted at a lower portion of the oven cavity 4. The bake element 6 is covered by a removable panel or plate 7, such as a porcelain plate. The removable panel 7 serves to hide the bake element 6 and provide a flat surface that is easily cleaned.

A convection heating system 8 develops convective air flows into and within the oven cavity 4. As shown schematically in FIG. 2, the convection heating system 8 includes a fan 21 and a convection heating element 22. The convection heating system 8 may be located inside of the oven cavity 4 within a housing, or exterior to the oven cavity. The fan draws air from the oven cavity and pushes or pulls the air past the heating element and back into the oven cavity. Accordingly, the convection heating system 8 develops a flow of heated air into and within the oven cavity 4. The convection heating element can be located adjacent to the fan.

The convection heating system 8 is shown located centrally on a rear inner wall of the oven cavity 4. However, the convection heating system 8 could be provided at other locations within the oven cavity 4, such as along a side wall, for example.

In an embodiment, the broil heating element 5, the bake heating element 6 and the convection heating element 22 are electrical resistance heating elements. The broil heating element 5, the bake heating element 6 and the convection heating element 22 have power ratings, for example, power ratings in watts. The power ratings are used, for example, to determine the appropriate size for overcurrent protection and electrical conductors that supply electrical energy to the heating elements. In an embodiment, the convection heating element 22 has a power rating that is less than the power rating of the bake heating element 6, and the bake heating element has a power rating that is less than the power rating of the broil heating element 5. An example power rating for the convection heating element is 350 W. Example power ratings for the bake heating element and the broil heating elements are 3500 W and 4000 W, respectively.

In further embodiments, one or more of the heating elements can be a gas heating element.

The cooking appliance 1 includes a control panel 9 comprising a plurality of user interface devices for allowing a user to control and monitor a cooking operation. The control panel includes a plurality of knobs 10 for activating and controlling the power level of the cooktop heating elements 2. The control panel 9 also includes a plurality of pushbuttons or touch-sensitive (e.g., capacitive) switches 11 (hereinafter referred to as "pushbuttons") for activating and controlling various cooking operations within the oven cavity 4. For example, convection and non-convection baking operations, a broil operation, and a self-cleaning operation can be initiated by pressing appropriate pushbuttons 11, along with setting a desired cooking temperature. The control panel 9 further includes a display 12, such as a light emitting diode (LED) display or a liquid crystal display (LCD). The display 12 provides miscellaneous information to the user regarding the operation of the cooking appliance 1, such as remaining cooking time, temperature setting, etc. The display 12 can include a touch-screen for allowing the user to input information directly from the display 12.

Figure 2:
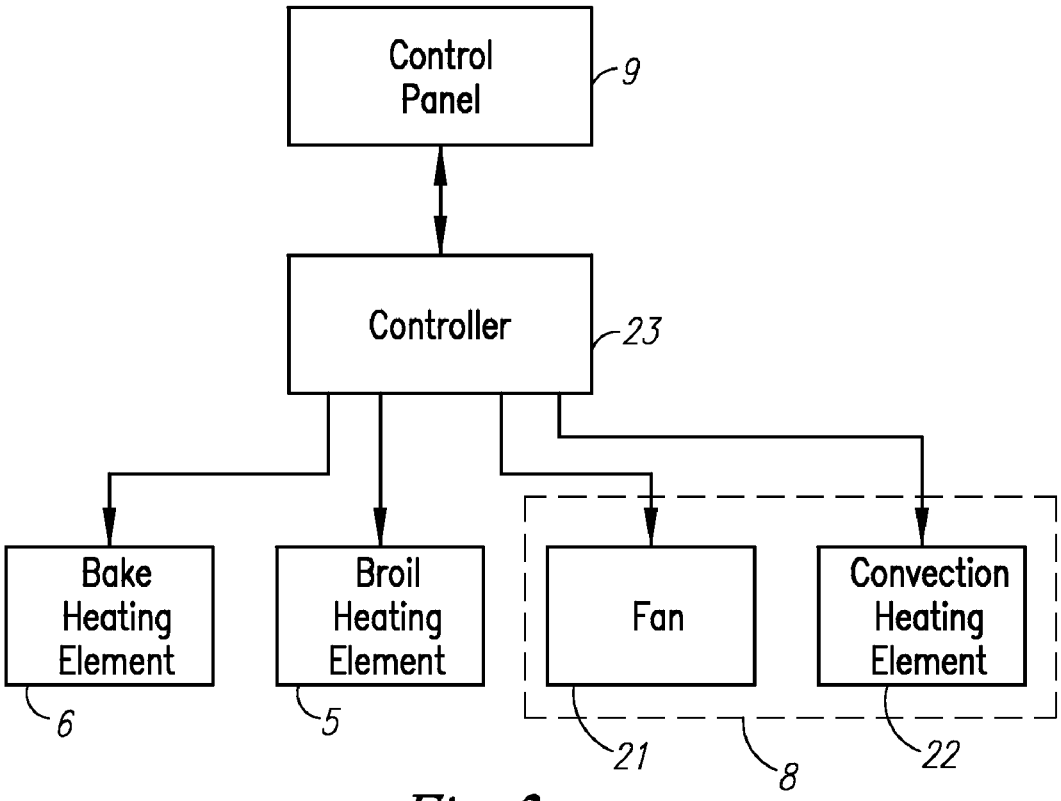
FIG. 2 is a schematic control diagram.

FIG. 2 provides a schematic illustration of a control system for controlling activations of the bake heating element 6, the broil heating element 7 and the convection heating system 8. A controller 23 communicates with and/or monitors the interface devices on the control panel 9 and can control the activation and deactivation of the bake 6, broil 5 and convection 22 heating elements and the fan 21 based on user inputs. The controller can include a plurality of logic circuits, and can include a programmable device, such as a microprocessor, for executing a program algorithm. The controller can further include a plurality of controllable switches, for example, relays, transistors, thyristors, silicon-controlled rectifiers, and the like, for controlling activations of the bake 6, broil 5 and convection 22 heating elements, and controlling activations of the fan 21.

Through the control panel 9, the user can select a convection bake operation and a non-convection bake operation. During a convection bake operation, the convection fan 21 runs to develop a flow of air within the oven cavity 4, which typically speeds up the cooking process. During a non-convection bake operation, the convection fan 21 does not run.

The controller 23 initiates and controls an oven cavity preheating operation, to bring the temperature of the oven cavity 4 up to a desired convection or non-convection baking temperature. For example, the preheating operation could raise the oven cavity temperature from a room temperature of approximately 70° F. to a baking temperature of 350° F., or some other desired baking temperature. The desired baking temperature is entered by the user at the control panel 9. The controller 23 will automatically initiate the preheating operation discussed below if the user selects either of the convection bake operation or the non-convection bake operation. However, the user can override the preheating operation, so that the preheating operation is not automatically performed, via a pushbutton on the control panel 9.

The oven cavity 4 preheating operation will now be discussed. During the oven cavity 4 preheating operation, the controller 23 activates the convection heating system 8. The controller 23 also alternately activates the bake heating element 6 and the broil heating element 5. The controller 23 causes the convection heating element 22 to be simultaneously activated with the bake heating element 6, and then alternately the broil heating element 5. The convection heating element 22 can be activated during the entire preheating operation.

The fan 21 is also activated during the preheating operation. Activation of the fan 21 develops a flow of heated air into and within the oven cavity, to help circulate heat emitted from the convection heating element 22 and speed up the preheating process. Activation of the fan 21 also helps to eliminate temperature differentials within the oven cavity 4. The fan 21 can be activated continuously for the entire duration of the preheating operation, or intermittently, or for some portion of the preheating operation. The fan 21 can be activated whenever the convection heating element 22 is activated.

As stated above, the controller 23 causes the convection heating element 22 to be simultaneously activated with the bake heating element 6, and alternately the broil heating element 5. During the preheating operation, the bake heating element 6 and the broil heating element 5 are alternately cycled on and off by the controller 23. The bake heating element 6 is activated for a longer time period than the boil heating element 5. For example, the bake heating element 6 can be activated for 40 seconds, followed by a 20 second activation of the broil heating element 5, followed by another 40 second activation of the bake heating element 6, followed by another 20 second activation of the broil heating element 5, and so on. Cycling of the bake and broil heating elements can continue for the entire preheating operation. If the bake and broil heating elements are cycled on for intervals of 40 s and 20 s, respectively, during the entire preheating operation, the bake heating element 6 will be activated for two-thirds of the entire preheating operation, which is twice as long as the broil heating element 5 will be activated. It is to be appreciated that other bake/broil element cycling intervals are possible, such as 30 s/30 s, 35 s/25 s, 45 s/15 s or 50 s/10 s. Longer bake/broil cycling intervals are also possible, such as a 60 s/30 s interval, as are shorter intervals, such as a 20 s/10 s interval.

During the preheating operation, the broil heating element 5 is cycled on for a longer time interval than may occur during the subsequent bake operation. For example, during a typical bake operation, the broil heating element 5 may be cycled on for 5 seconds of each minute. However, during the preceding preheating operation, the broil heating element 5 may be cycled on for 20 seconds of each minute, or longer.

The cooking appliance 1 may include a safety circuit, such as an interlock circuit, to prevent simultaneous activation of the broil heating element 5 and the bake heating element 6. Additionally, or in the alternative, the controller 23 may be configured or programmed to only activate one of the broil heating element 5 and the bake heating element 6 at a time. By preventing the simultaneous activation of the broil 5 and the bake 6 heating elements, both of which have large power ratings, the maximum electrical current draw by the cooking appliance 1 is reduced, and overcurrent protection and electrical conductors for the cooking appliance 1 can be sized accordingly.

The controller 23 activates an audible and/or visual annunciator when the oven cavity 4 reaches the desired baking temperature, to inform the user that the oven cavity is up to temperature. Example annunciators include buzzers, chimes, tone generators, and indicator lights, for example, LED indicator lights. If a non-convection bake operation is to be performed, the convection heating system is turned off when the oven cavity preheating operation is complete.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A cooking appliance, comprising:

a cabinet forming an oven cavity;

a broil heating element;

a bake heating element;

a convection heating system including a fan and a convection heating element for developing a flow of heated air into the oven cavity;

a controller for controlling activations of the broil, bake and convection heating elements during an oven cavity preheating operation in which the broil heating element and the bake heating element are alternately activated while the convection heating element is activated; and, a control panel for allowing user selections of a convection baking operation and a non-convection baking operation, wherein the controller initiates said preheating operation based on a selection of the non-convection baking operation.

2. The cooking appliance as set forth in claim 1, wherein the convection heating element has a power rating that is less than a power rating of the broil heating element and less than a power rating of the bake heating element.

3. The cooking appliance as set forth in claim 1, further comprising a removable panel installed in the oven cavity for covering the bake heating element.

4. The cooking appliance as set forth in claim 1, wherein the bake heating element is activated for a longer time than the broil heating element during the preheating operation.

5. The cooking appliance as set forth in claim 1, wherein the bake heating element is activated for approximately two-thirds of the entire preheating operation, and wherein the broil element is activated for approximately one-third the entire preheating operation.

6. The cooking appliance as set forth in claim 1, wherein the bake heating element is activated for approximately twice as long as the broil heating element during the preheating operation.

7. The cooking appliance as set forth in claim 1, wherein the fan is activated whenever the convection heating element is activated during said preheating operation.

8. The cooking appliance as set forth in claim 7, wherein the fan and the convection heating element are activated during approximately the entire preheating operation.

9. The cooking appliance as set forth in claim 1, further comprising an interlock circuit configured to prevent simultaneous activation of the broil heating element and the bake heating element.

10. A cooking appliance, comprising:

a cabinet forming an oven cavity;

a broil heating element;

a bake heating element;

a convection heating system including a fan and a convection heating element for developing a flow of heated air within the oven cavity, wherein the convection heating element has a power rating that is less than a power rating of the broil heating element and a power rating of the bake heating element;

a controller for controlling activations of the broil, bake and convection heating elements during an oven cavity preheating operation in which the broil heating element and the bake heating element are alternately activated while the convection heating element is activated; and, a control panel having a non-convection baking operation selection, wherein the controller automatically initiates said preheating operation using the convection heating element when the non-convection baking operation is selected by a user.

11. The cooking appliance as set forth in claim 10, further comprising an interlock circuit configured to prevent simultaneous activation of the broil heating element and the bake heating element.

12. The cooking appliance as set forth in claim 10, further comprising a removable panel installed in the oven cavity for covering the bake heating element.

13. The cooking appliance as set forth in claim 10, further comprising a removable panel installed in the oven cavity for covering the bake heating element.

14. The cooking appliance as set forth in claim 10, wherein the fan and the convection heating element are activated during approximately the entire preheating operation.

15. The cooking appliance as set forth in claim 10, wherein the bake heating element is activated for a longer time than the broil heating element during the preheating operation.

16. The cooking appliance as set forth in claim 15, wherein the bake heating element is activated for approximately two-thirds of the entire preheating operation, and wherein the broil element is activated for approximately one-third the entire preheating operation.

17. The cooking appliance as set forth in claim 15, wherein the bake heating element is activated for approximately twice as long as the broil heating element during the preheating operation.

* * * * *